US010598425B2

(12) United States Patent
Choi et al.

(10) Patent No.: US 10,598,425 B2
(45) Date of Patent: Mar. 24, 2020

(54) LIFTING APPARATUS AND REFRIGERATOR HAVING THE SAME

(71) Applicant: Samsung Electronics Co., Ltd., Suwon-si, Gyeonggi-do (KR)

(72) Inventors: Jin Seung Choi, Suwon-si (KR); Min Soo Kim, Seoul (KR); Sung Jin Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 99 days.

(21) Appl. No.: 15/917,431

(22) Filed: Mar. 9, 2018

(65) Prior Publication Data

US 2018/0259246 A1 Sep. 13, 2018

(30) Foreign Application Priority Data

Mar. 10, 2017 (KR) ..... 10-2017-0030450

(51) Int. Cl.
*F25D 25/00* (2006.01)
*F25D 25/02* (2006.01)
(Continued)

(52) U.S. Cl.
CPC ..... *F25D 25/025* (2013.01); *A47B 51/00* (2013.01); *A47B 88/423* (2017.01); *A47B 88/46* (2017.01);
(Continued)

(58) Field of Classification Search
CPC ..... F25D 23/02; F25D 25/02; F25D 25/05; F25D 23/021; F25D 23/067;
(Continued)

(56) References Cited

U.S. PATENT DOCUMENTS 2,875,012 A * 2/1959 Riley ..... A47B 51/00 312/312
2,885,252 A * 5/1959 Doesken ..... A47B 49/008 312/319.2
(Continued)

FOREIGN PATENT DOCUMENTS

JP 2014-059102 A 4/2014
KR 10-2006-0011221 A 2/2006
(Continued)

*Primary Examiner* — Janet M Wilkens

(57) ABSTRACT

Disclosed herein is a lifting apparatus and refrigerator having the same, by which a driving motor to generate driving force to vertically move a basket may be miniaturized and the load of the driving motor may be reduced. A refrigerator includes a main body, a storeroom formed inside the main body with an open front, a drawer slidingly coupled with the main body to open or close the storeroom and provided at a lower side thereof with a basket having storage space, and a lifting apparatus moving the basket vertically, wherein the lifting apparatus includes a driving motor, a driving shaft rotated by the driving motor, a lifting unit moving the basket vertically by means of rotational force of the driving shaft, and a coil spring coupled to the driving shaft and transferring energy in a direction in which the driving shaft is rotated to reduce a load of the driving motor, when the driving shaft is rotated to move the basket upward.

20 Claims, 12 Drawing Sheets

(51) Int. Cl.

| | |
|---|---|
| ***A47B 51/00*** | (2006.01) |
| ***A47B 88/90*** | (2017.01) |
| ***A47B 88/46*** | (2017.01) |
| ***F25D 25/04*** | (2006.01) |
| ***A47B 88/423*** | (2017.01) |

(52) U.S. Cl.
CPC ..... *A47B 88/90* (2017.01); *F25D 25/022* (2013.01); *F25D 25/04* (2013.01); *A47B 2088/4235* (2017.01); *A47B 2088/901* (2017.01); *A47B 2210/17* (2013.01); *A47B 2210/175* (2013.01)

(58) Field of Classification Search
CPC .... F25D 23/087; F25D 23/028; F25D 29/005; A47B 51/00; A47B 21/02; A47B 2220/0013; A47B 9/12
USPC ..... 312/330.1, 350, 306, 312, 402, 404, 312/319.5–319.8
See application file for complete search history.

(56) References Cited

U.S. PATENT DOCUMENTS 3,415,586 A * 12/1968 Hammond ..... A47B 51/00 312/312
3,438,687 A * 4/1969 Wikey ..... D05B 75/06 312/21
4,697,857 A * 10/1987 Annas, Sr. ..... B65G 1/07 312/21
5,031,975 A * 7/1991 Anderson ..... A47B 77/10 108/20
5,129,611 A * 7/1992 Grover ..... F16M 11/42 108/147
5,797,666 A * 8/1998 Park ..... A47B 21/0073 312/223.3
6,766,747 B1 * 7/2004 Wolfe ..... A47B 13/081 108/26
7,396,093 B2 * 7/2008 Jeong ..... A47B 46/00 312/402
10,098,451 B2 * 10/2018 Keller ..... A47B 9/02
2006/0087207 A1 * 4/2006 Oh ..... A47B 51/00 312/402
2014/0265797 A1 * 9/2014 Scheuring ..... A47B 51/00 312/404
2014/0265798 A1 * 9/2014 Watts ..... F25D 23/04 312/404
2014/0265806 A1 * 9/2014 Hall ..... F25D 25/025 312/408
2019/0219324 A1 * 7/2019 Kang ..... F25D 25/022

FOREIGN PATENT DOCUMENTS

KR 10-2006-0019120 A 3/2006
KR 10-2007-0080104 A 8/2007

* cited by examiner

LIFTING APPARATUS AND REFRIGERATOR HAVING THE SAME

CROSS-REFERENCE TO RELATED APPLICATION

This application is based on and claims priority under 35 U.S.C. § 119 to Korean Patent Application No. 10-2017-0030450 filed on Mar. 10, 2017, in the Korean Intellectual Property Office, the disclosure of which is incorporated herein by reference in its entirety.

TECHNICAL FIELD

The present disclosure relates to a lifting apparatus and a refrigerator having the same for moving a basket vertically.

BACKGROUND

Refrigerators are devices having a storeroom and a cold air supply for supplying cold air into the storeroom to keep groceries fresh.

Temperatures in the storeroom remain within a certain range required to keep the groceries fresh.

The storeroom has an open front, which is closed by a door at ordinary times to maintain the temperature of the storeroom.

The storeroom is divided into a top chamber, a middle chamber, and a bottom chamber. The top chamber is used as a fridge room, the middle chamber is used as an adjustable temperature room, and the bottom chamber is used as a freezer room.

The top chamber used as the fridge room is opened and closed by a French door split into two pieces pivotally combined with the main body, and the middle chamber used as the adjustable temperature room and the bottom chamber used as the freezer room are opened and closed by slidable drawers.

A basket with storage space is arranged behind the drawer to be vertically moved by a lifting apparatus.

The lifting apparatus includes a driving motor to generate the driving force to vertically move the basket.

The driving motor requires high output due to the weight of the food stored in the storage space of the basket, which causes an increase in manufacturing costs.

Furthermore, as the load capacitance of the driving motor increases, the volume occupied by the driving motor in the refrigerator increases, which reduces the storage space available to the user.

SUMMARY

Therefore, it is an aspect of the present disclosure to provide a lifting apparatus and a refrigerator having the same, by which a driving motor to generate driving force to vertically move a basket may be miniaturized and the load of the driving motor may be reduced.

Additional aspects of the disclosure will be set forth in part in the description which follows and, in part, will be obvious from the description, or may be learned by practice of the disclosure.

In accordance with one aspect of the present disclosure, a refrigerator includes a main body, a storeroom formed inside the main body with an open front, a drawer slidingly coupled with the main body to open or close the storeroom and provided at a lower side thereof with a basket having storage space, and a lifting apparatus moving the basket vertically, wherein the lifting apparatus includes a driving motor, a driving shaft rotated by the driving motor, a lifting unit moving the basket vertically by means of rotational force of the driving shaft, and a coil spring coupled to the driving shaft and transferring energy in a direction in which the driving shaft is rotated to reduce a load of the driving motor, when the driving shaft is rotated to move the basket upward.

The lifting unit may comprise a double pulley moving the basket vertically, a plurality of pulleys transferring rotational force of the driving shaft to the double pulley, a vertical guide rail guiding vertical movement of the basket, and a housing in which the double pulley is installed.

The double pulley may comprise a first double pulley and a second double pulley arranged on either side of the basket.

The first double pulley and the second double pulley may comprise a belt coupled at one end to at least one of the plurality of pulleys, a fixed pulley fixed to the housing and coupled by the belt to at least one of the plurality of pulleys, a movable pulley coupled by the belt to the fixed pulley to be vertically moved inside the housing, a coupling plate coupled to a side wall of the basket to be vertically moved along with the movable pulley, and a fixed rod to which the other end of the belt is fixed.

The plurality of pulleys may comprise a first pulley coupled with the driving shaft and coupled by the belt to the fixed pulley of the first double pulley, a second pulley coupled by the belt to the fixed pulley of the second double pulley, and a third pulley coupled by the belt to the second pulley.

The belt has a width three times larger than its thickness to keep the basket horizontally balanced while the basket may be vertically moving.

The belt may comprise a first belt coupling the fixed pulley and the movable pulley of the first double pulley and the first pulley, and a second belt coupling the fixed pulley and the movable pulley of the second double pulley and the second pulley.

The plurality of pulleys further may comprise: a fourth pulley arranged to be adjacent to the third pulley between the second pulley and the third pulley, and placed lower than the third pulley to prevent contact between the second belt and the basket.

The housing may comprise a first housing containing the first double pulley and a second housing containing the second double pulley, and the first and second housings each may have one open side for the coupling plate to be coupled with the basket to be vertically moved.

The first housing and the second housing may comprise a first rotation hole to which the fixed pulley is rotationally coupled, a fixed hole to which the fixed rod is fixed, and a guide rail coupler to which the vertical guide rail is coupled.

The first housing further may comprise a driving motor container in which the driving motor is contained, a second rotation hole to which the driving shaft is rotationally coupled, and an anti-exposer preventing the driving shaft from being exposed to outside.

The second housing further may comprise a third rotation hole to which the third pulley is rotationally coupled.

The first housing and the second housing may be coupled at their bottom ends with an auxiliary plate to connect the first housing and the second housing, the auxiliary plate may comprise a fixer to which the other end of the coil spring is fixed.

The coil spring may be coupled at one end to the driving shaft by a coupling member, the coupling member being formed of a flexible material and may wind on the driving shaft or may unwind from the driving shaft depending on the direction of rotation of the driving shaft.

When the driving shaft is rotated to move the basket upward, the coupling member wound on the driving shaft is unwound and elastic energy of the coil spring may be transferred to the driving shaft, and when the driving shaft is rotated to move the basket downward, the coupling member is wound on the driving shaft and the coil spring may store elastic energy.

In accordance with another aspect of the present disclosure, a refrigerator includes a main body, a storeroom formed inside the main body with an open front, a drawer slidingly coupled with the main body to open or close the storeroom and provided at a lower side thereof with a basket having storage space, and a lifting apparatus moving the basket vertically, wherein the lifting apparatus includes a driving motor, a driving shaft rotated by the driving motor, a lifting unit comprising a belt coupled to the driving shaft, a fixed pulley fixed not to be moved and coupled to the driving shaft by the belt, and a movable pulley coupled to the fixed pulley by the belt to be vertically moved to move the basket vertically, and a coil spring transferring energy in a direction in which the driving shaft is rotated to reduce a load of the driving motor, when the driving shaft is rotated to move the basket upward.

The lifting unit further may comprise a plurality of pulleys coupled to one end of the belt, a fixed rod to which the other end of the belt is fixed, a vertical guide rail guiding vertical movement of the basket to prevent swaying of the basket.

In accordance with another aspect of the present disclosure, a lifting apparatus for moving a basket vertically includes a driving motor generating driving force, a driving shaft rotated by the driving motor, a belt coupled to the driving shaft, a fixed pulley coupled by the belt to the driving shaft and fixed not to be moved, a movable pulley coupled to the fixed pulley by the belt to be vertically moved, a coupling plate coupled with a side wall of the basket and vertically moved along with the movable pulley, and a coil spring transferring energy in a direction in which the driving shaft is rotated to reduce a load of the driving motor, when the driving shaft is rotated to move the basket upward.

The fixed pulley, the movable pulley, and the coupling plate may be each provided in pair and may arrange on both side walls of the basket, and the fixed pulleys may be fixed to a pair of housings arranged on both side walls of the basket.

The pair of housings may be coupled at their bottom ends with an auxiliary plate to connect the pair of housings, and the coil spring may be coupled at one end to the driving shaft by a coupling member and may fix at the other end to a fixer arranged on the auxiliary plate.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION

Figure 1:
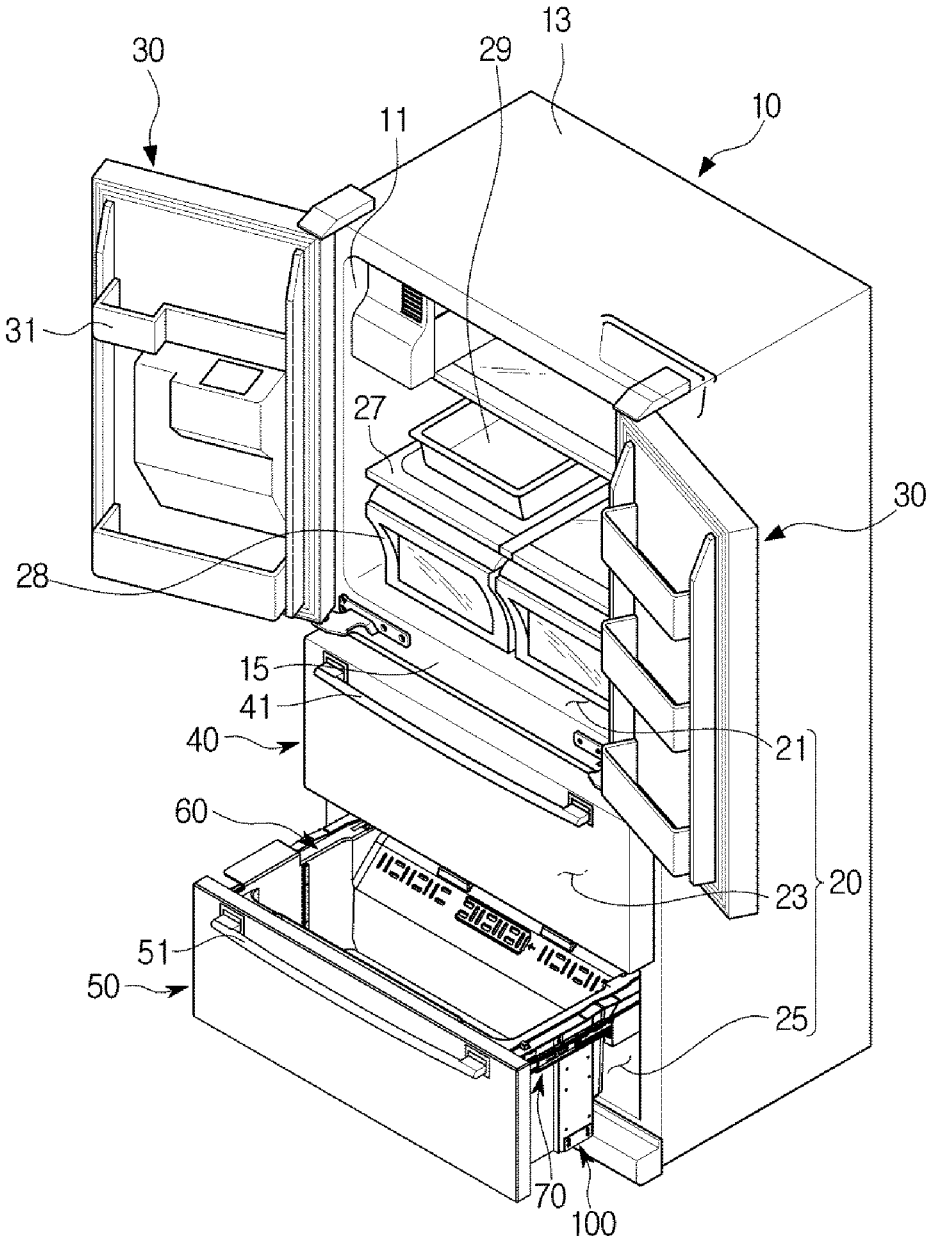
FIG. 1 is a perspective view of a refrigerator, according to an embodiment of the present disclosure.

Embodiments and features as described and illustrated in the present disclosure are only preferred examples, and various modifications thereof may also fall within the scope of the disclosure.

Throughout the drawings, like reference numerals refer to like parts or components.

The terminology used herein is for the purpose of describing particular embodiments only and is not intended to limit the present disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or chamber discussed below could be termed a second element, component, region, layer or section without departing from the teachings of the present disclosure. Descriptions shall be understood as to include any and all combinations of one or more of the associated listed items when the items are described by using the conjunctive term "~ and/or ~," or the like.

The terms "front", "rear", "upper", "lower", "top", and "bottom" as herein used are defined with respect to the drawings, but the terms may not restrict the shape and position of the respective components.

In general, refrigerators may be classified by types based on the form of storerooms and doors.

There may be top mounted freezer (TMF) typed refrigerators in which a storeroom is partitioned by a horizontal partition wall into upper and lower chambers with a freezer formed in the upper chamber and a fridge formed in the lower chamber, and bottom mounted freezer (BMF) typed refrigerators in which a fridge is formed in the upper chamber and a freezer is formed in the lower chamber.

Furthermore, there may be side by side (SBS) typed refrigerators in which a storeroom is partitioned by a vertical partition wall into left and right chambers with a freezer formed in one chamber and a fridge formed in the other chamber, and French door refrigerator (FDR) typed refrigerators in which a storeroom is partitioned by a horizontal partition wall into upper and lower chambers with a fridge formed in the upper chamber and a freezer formed in the lower chamber.

In embodiments of the present disclosure, the FDR typed refrigerator will now be focused for convenience of explanation, but embodiments of the present disclosure are not limited to the FDR typed refrigerators.

Embodiments of the present disclosure will now be described in detail with reference to accompanying drawings.

Figure 2:
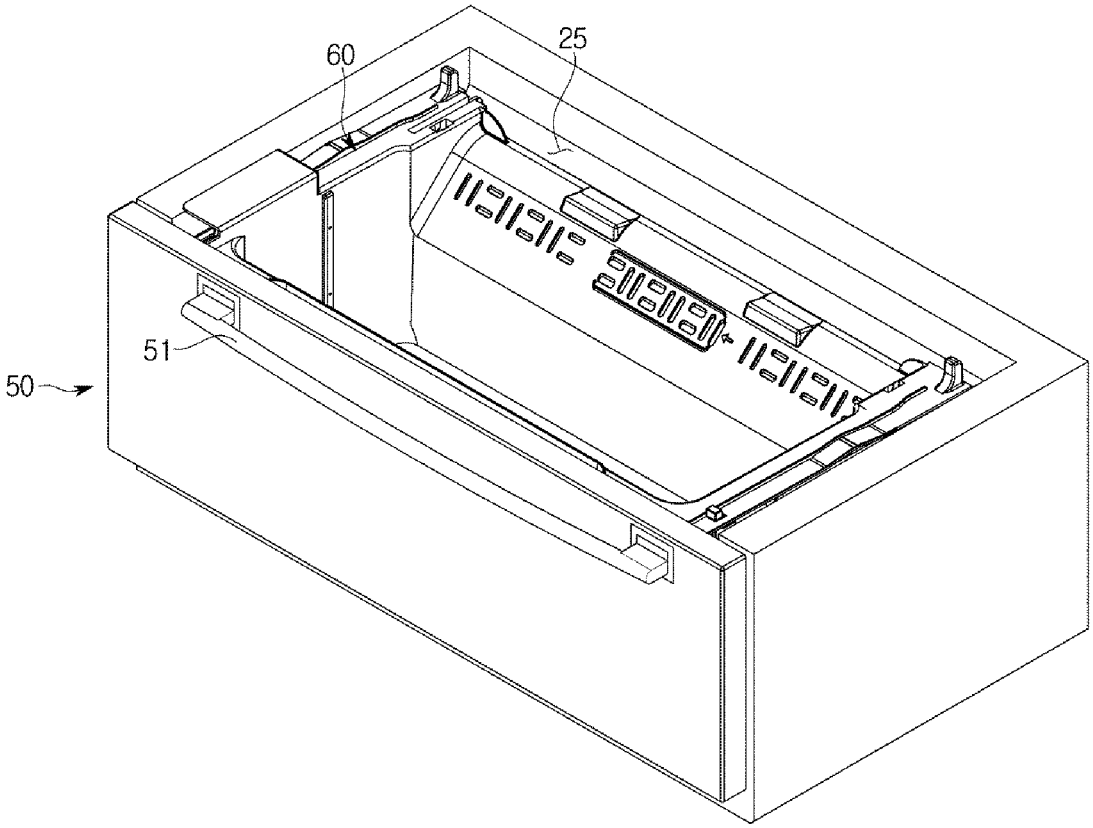
FIG. 2 shows a basket put in a bottom chamber, according to an embodiment of the present disclosure.
Figure 3:
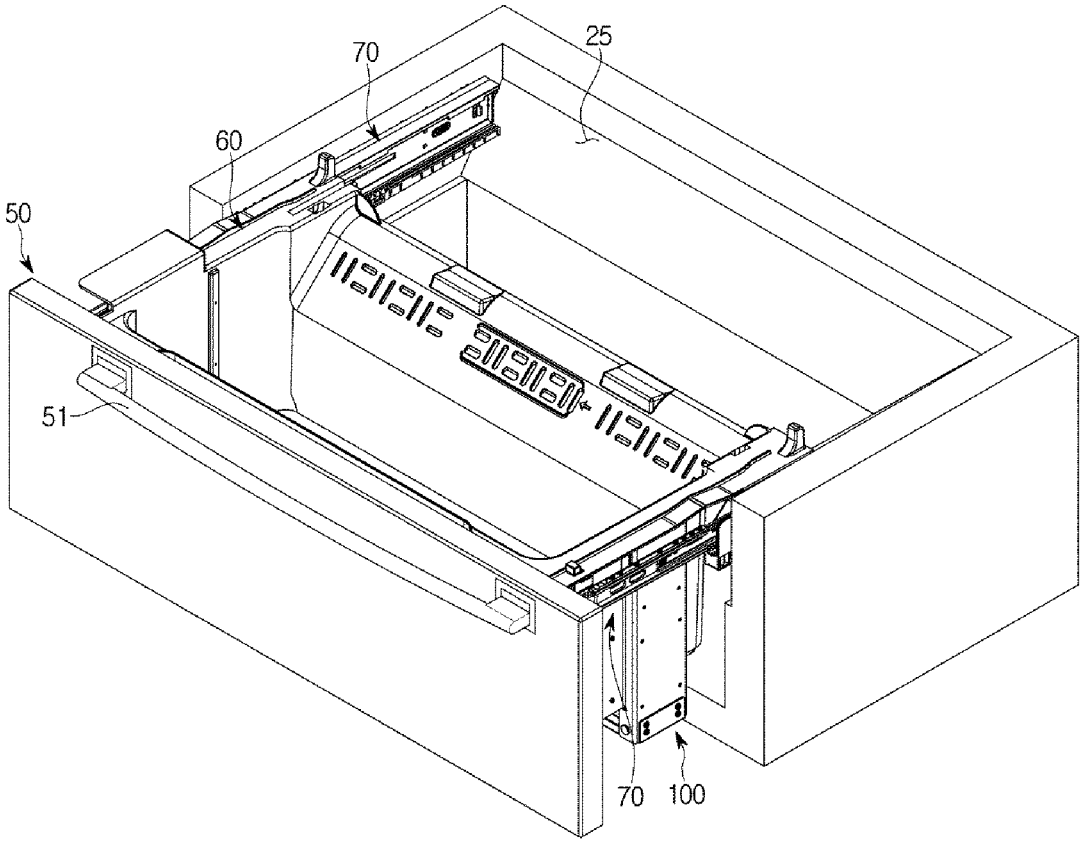
FIG. 3 shows a basket pulled out of a bottom chamber by horizontal guide rails, according to an embodiment of the present disclosure.

FIG. 1 is a perspective view of a refrigerator, according to an embodiment of the present disclosure, FIG. 2 shows a basket put in a bottom chamber, according to an embodiment of the present disclosure, and FIG. 3 shows a basket pulled out of a bottom chamber by horizontal guide rails, according to an embodiment of the present disclosure.

Referring to FIGS. 1 to 3, a refrigerator may include a main body 10, a storeroom 20 with multiple chambers provided inside the main body 10 to have open front, and doors 30, 40, 50 to open or close the open front of the storerooms 20.

The main body 10 may include an inner casing 11 forming the storeroom 20, an outer casing 13 forming the exterior, and a cold air supply (not shown) for supplying cold air to the storeroom 20.

The cold air supply may include a compressor (not shown), a condenser (not shown), an expansion valve (not shown), an evaporator (not shown), a blower fan (not shown), a cold air duct (not shown), etc., and there may be an insulation (not shown) foamed between the inner casing 11 and the outer casing 13 of the main body 10 to prevent the cold air from leaking out from the storerooms 20.

A machine room 23 where the compressor for compressing refrigerants and the condenser for condensing the compressed refrigerants are installed may be contained in a rear bottom portion of the main body 10.

The storeroom 20 is divided by partition walls 15 into multiple chambers including a top chamber 21, a middle chamber 23, and a bottom chamber 25 from top to bottom, each chamber keeping groceries cool or frozen as required.

The top chamber 21 may be formed as a fridge room, and equipped with a plurality of shelves 27 dividing the top chamber 21 into multiple compartments, and with at least one container 28 and tray 29 to store groceries or some other items.

The doors 30, 40, 50 to open or close the storeroom 20 may include French doors 30 pivotally combined with the main body 10 to open or close the open front of the top chamber 21, and drawer type doors, i.e., drawers 40, 50, sliding in and out of the middle chamber 23 and the bottom chamber 25.

The top chamber 21 may be opened or closed by the French doors 30 pivotally combined with the main body 10, and a plurality of door guards 31 may be installed on the rear side of the French doors 30 to contain groceries.

The middle chamber 23 and the bottom chamber 25 may be formed as an adjustable temperature chamber and a freezer chamber, respectively, and may be opened or closed by the drawers 40 that are slidable against the main body 10.

Although the top chamber 21, the middle chamber 23, and the bottom chamber 25 are shown to be formed as the fridge chamber, the adjustable temperature chamber, and the freezer chamber, respectively, the present disclosure is not limited thereto.

A container (not shown) may be combined with the rear side of the drawer 40 that opens or closes the middle chamber 23, and the front of the drawer 40 has a handle 41 to be gripped by the user to pull in or pull out the container to or from the middle chamber 23 along with the drawer 40.

A basket 60 with storage space is arranged behind the drawer 50 that opens or closes the bottom chamber 25, and the front of the drawer 50 has a handle 51 to be gripped by the user to pull in or pull out the basket 60 to or from the bottom chamber 25 along with the drawer 50.

As shown in FIGS. 1 to 3, the drawers 40, 50 are slidingly moved by horizontal guide rails 70 to pull into or pull out from the middle chamber 23 and the bottom chamber 25.

Although the drawer 50 is just shown as being slidingly moved by the horizontal guide rails 70 in the figures, the drawer 40 may also be slidingly moved by the horizontal guide rails 70.

The basket 60 may be vertically moved by a lifting apparatus 100. Specifically, when the lifting apparatus 100 is driven while the basket 60 is pulled out of the lower chamber 25, the basket 60 may be moved upward or downward.

Figure 4:
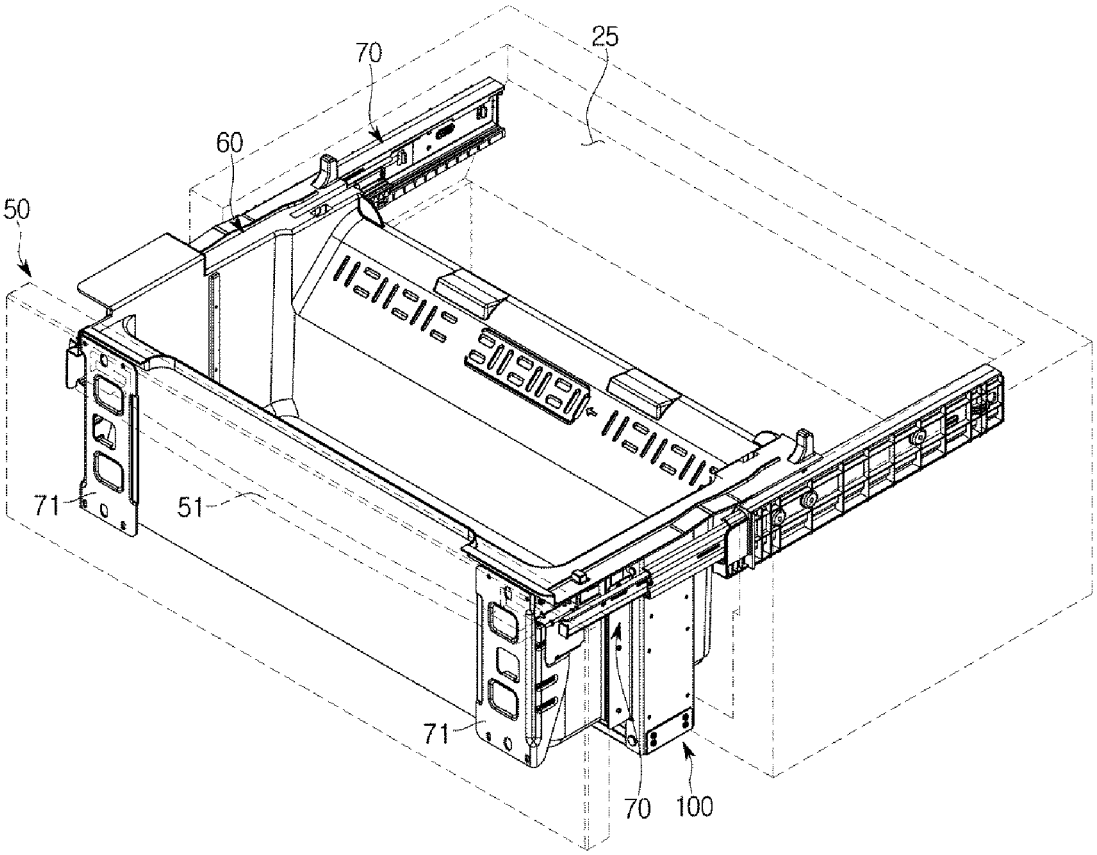
FIG. 4 shows a basket to be put into or pulled out of a bottom chamber, according to an embodiment of the present disclosure.
Figure 5:
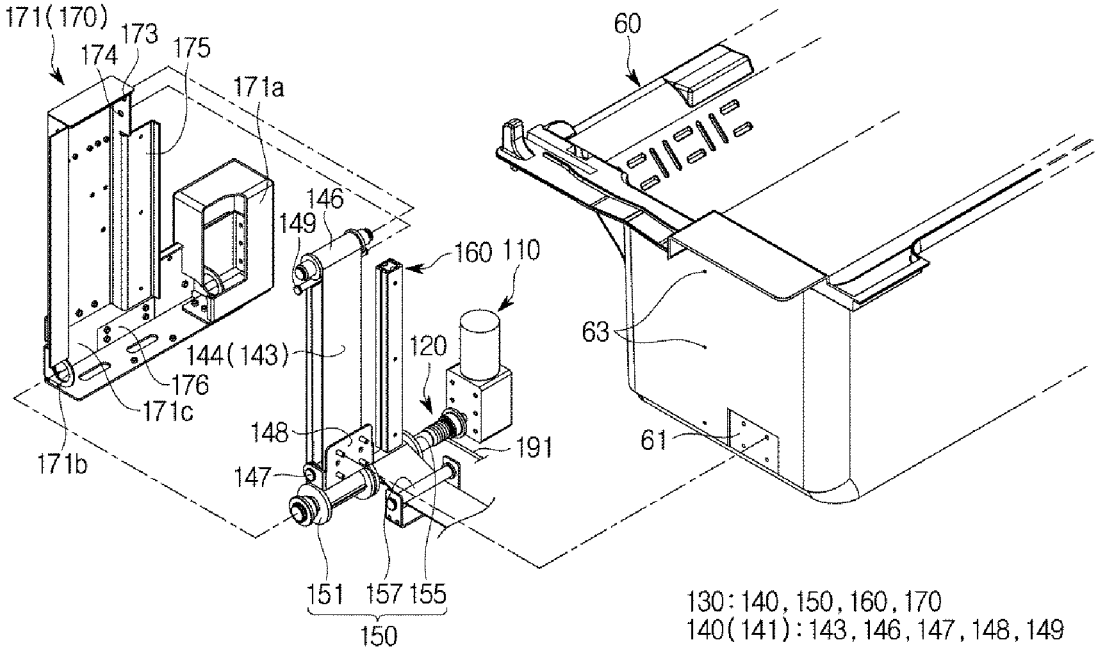
FIG. 5 shows a lifting apparatus arranged on one side of a basket, according to an embodiment of the present disclosure.
Figure 6:
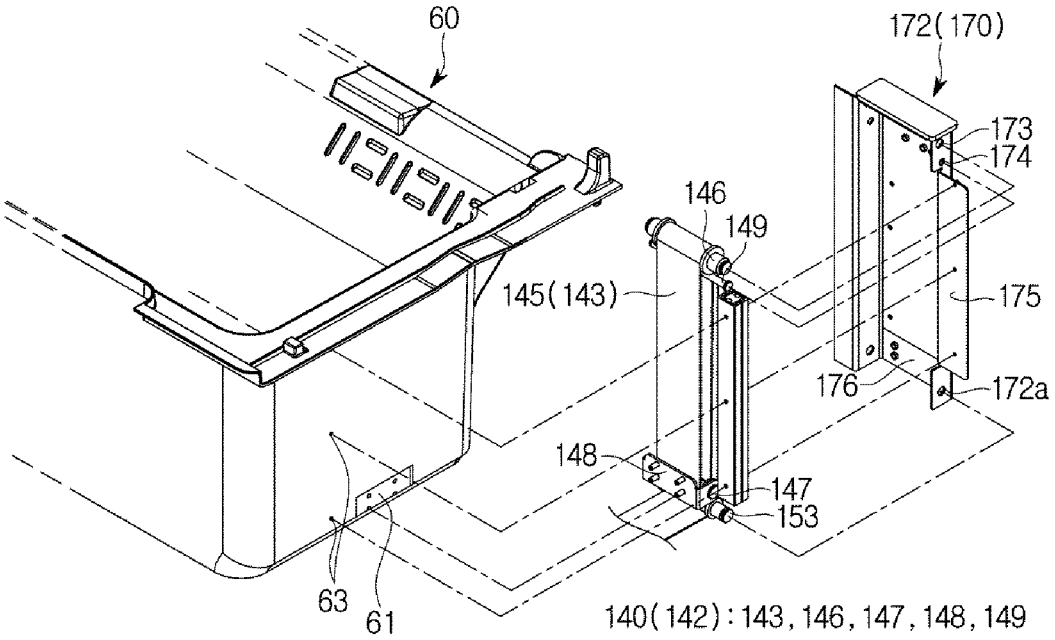
FIG. 6 shows a lifting apparatus arranged on the other side of the basket, according to an embodiment of the present disclosure.
Figure 7:
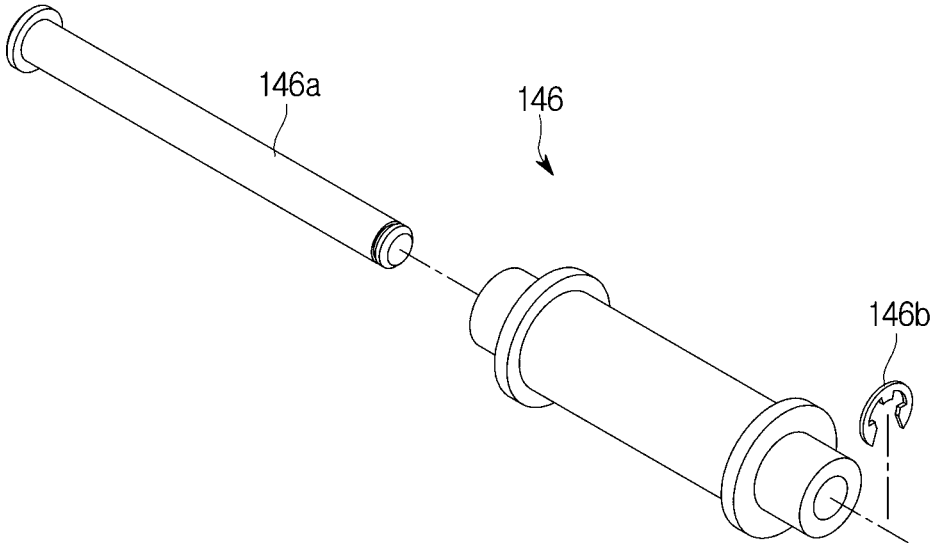
FIG. 7 is an exploded perspective view of a fixed pulley, according to an embodiment of the present disclosure.
Figure 8:
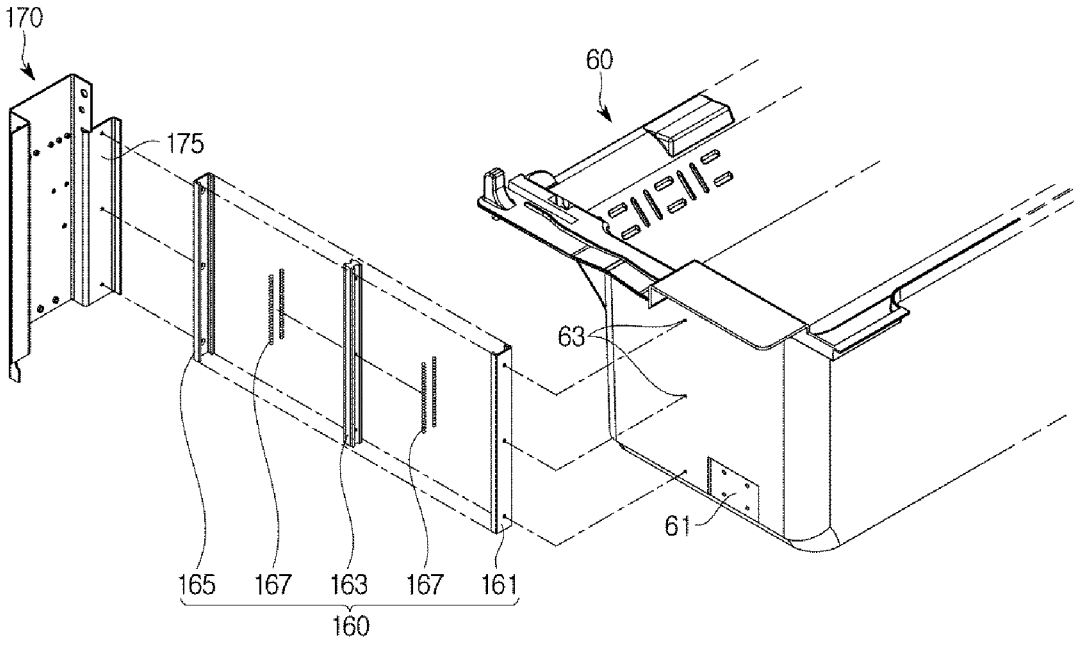
FIG. 8 shows coupling of a vertical guide rail to a basket and a housing, according to an embodiment of the present disclosure.
Figure 9:
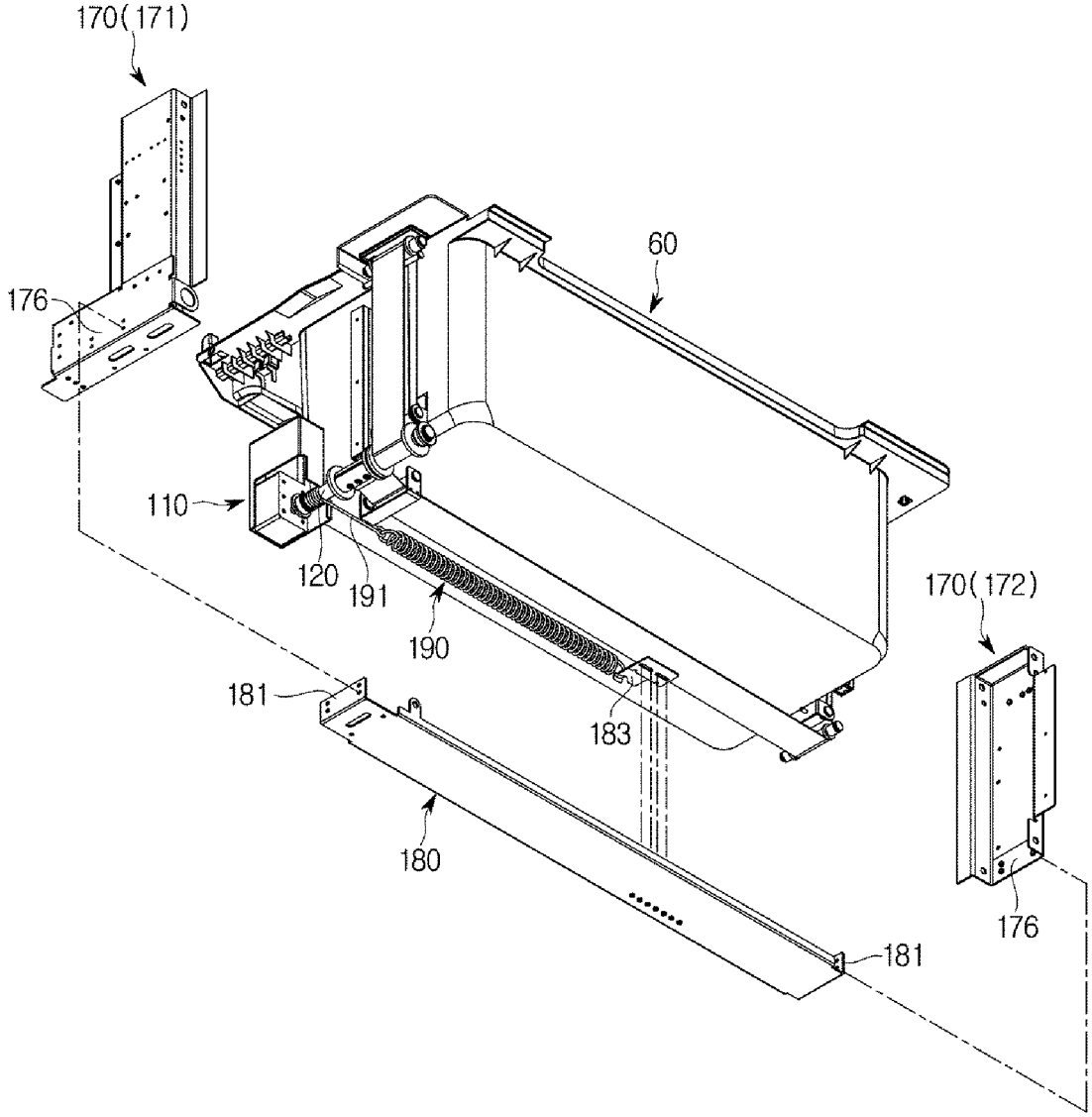
FIG. 9 shows coupling of an auxiliary plate to a housing, according to an embodiment of the present disclosure.

FIG. 4 shows a basket to be put into or pulled out of a bottom chamber, according to an embodiment of the present disclosure, FIG. 5 shows a lifting apparatus provided by one side of a basket, according to an embodiment of the present disclosure, FIG. 6 shows a lifting apparatus provided by the other side of the basket, according to an embodiment of the present disclosure, FIG. 7 is an exploded perspective view of a fixed pulley, according to an embodiment of the present disclosure, FIG. 8 shows coupling of a vertical guide rail to a basket and a housing, according to an embodiment of the present disclosure, and FIG. 9 shows coupling of an auxiliary plate to a housing, according to an embodiment of the present disclosure.

Referring to FIG. 4, the drawer 50 slides into or slid out of the bottom chamber 25 by the horizontal guide rails 70.

The horizontal guide rails 70 are coupled to both walls of the bottom chamber 25, and there are fastening plates 71 provided on the front ends of the horizontal guide rails 70 to be fastened to the rear face of the drawer 50.

The drawer 50 is supported by the horizontal guide rails 70 by being fastened to the horizontal guide rails 70 by the fastening plates 71.

The basket 60 arranged behind the drawer 50 may be vertically moved by the lifting apparatus 100 while pulled out of the bottom chamber 25 along with the drawer 50.

Referring to FIGS. 5 to 9, a lifting apparatus 100 includes a driving motor 110 for generating driving force, a driving shaft 120 coupled with and rotated by the driving motor 110, a lifting unit 130 coupled with the driving shaft 120 for moving the basket 60 up or down by means of the rotational force of the driving shaft 120, an auxiliary plate 180 to which a coil spring 190 is fixed, and the coil spring 190 coupled to the driving shaft 120 at one end and fixed to the auxiliary plate 180 at the other end.

The driving motor 110 is contained in a housing 170, which will be described below, and placed by a side of the basket 60.

The driving shaft 120 is coupled with and rotated by the driving motor 110 for transferring rotational force of the driving shaft 120 to the lifting unit 130.

The lifting unit 130 may include a double pulley 140 for vertically moving the basket 60 by means of the rotational force of the driving shaft 120, a plurality of pulleys 150 for transferring the rotational force of the driving shaft 120 to the double pulley 140, a vertical guide rail 160 for guiding the basket 60 up or down, and the housing 170 for containing the driving motor 110, the driving shaft 120, the double pulley 140, the plurality of pulleys 150, and the vertical guide rail 160.

The double pulley 140 may include a first double pulley 141 and a second double pulley 142 arranged by either side of the basket 60.

The first double pulley 141 is provided by a side of the basket 60, where the driving motor 110 and the driving shaft 120 are arranged, and the second double pulley 142 is provided by the other side of the basket 60, which is the opposite side to the side by which the first double pulley 141 is arranged.

The first and second double pulleys 141 and 142 are arranged on either side of the basket 60, and the structures of them are the same although their positions are different. Accordingly, in the following description, the structure of the first double pulley 141 will only be focused.

Since the structures of the first and second double pulleys 141 and 142 are the same, like elements refer to like reference numerals.

The first double pulley 141 may include a belt 143 connected at one end to a first pulley 151 among the plurality of pulleys 150, a fixed pulley 146 fixed to the housing 170 and connected to the first pulley 151 by the belt 143, a movable pulley 147 connected to the fixed pulley 146 by the belt 143 to be moved vertically, a coupling plate 148 coupled on one side to the movable pulley 147 and coupled on the other side to a side wall of the basket 60, and a fixed rod 149 to which the other end of the belt 143 is fixed.

Although it is shown that the rotational force of the driving shaft 120 is transferred by the belt 143 to the first and second double pulleys 141 and 142, it is not limited thereto.

The belt 143 may be replaced by a flexible rope, wire, or chain.

The belt 143 may include a first belt 144 included in the first double pulley 141 to connect the fixed pulley 146 and the movable pulley 147 of the first double pulley 141 and the first pulley 151, and a second belt 145 included in the second double pulley 142 to connect the fixed pulley 146 and the movable pulley 147 of the second double pulley 142 and a second pulley 153.

The belt 143 may have the width three times larger than its thickness, to keep the basket 60 balanced horizontally while the basket 60 is moving up or down.

The first belt 144 is coupled at one end to the first pulley 151 and fixed at the other end to the fixed rod 149 of the first double pulley 141. The fixed pulley 146 and the movable pulley 147 are arranged between the first pulley 151 and the fixed rod 149.

When the driving shaft 120 is rotated by the driving motor 110, the first belt 144 is wound on the first pulley 151 coupled with and rotated by the driving shaft 120 and the movable pulley 147 is moved upward.

When the movable pulley 147 is moved upward, the basket 60 coupled with the movable pulley 147 by the coupling plate 148 is moved upward.

When the driving shaft 120 is rotated in the opposite direction to the direction of when the basket 60 is moved upward, the first belt 144 wound on the first pulley 151 is unwound and the movable pulley 147 is moved downward.

When the movable pulley 147 is moved downward, the basket 60 coupled by the coupling plate 148 with the movable pulley 147 is moved downward as well.

The second belt 145 is coupled at one end to a third pulley 155 and fixed at the other end to the fixed rod 149 of the second double pulley 142. The second puley 153, the fixed pulley 146 and the movable pulley 147 are arranged between the third pulley 155 and the fixed rod 149.

When the driving shaft 120 is rotated by the driving motor 110, the second belt 145 is wound on the third pulley 155 rotated by the driving shaft 120 and the movable pulley 147 is moved upward.

When the movable pulley 147 is moved upward, the basket 60 coupled with the movable pulley 147 by the coupling plate 148 is moved upward.

When the driving shaft 120 is rotated in the opposite direction to the direction of when the basket 60 is moved upward, the second belt 145 wound on the third pulley 155 is unwound and the movable pulley 147 is moved downward.

When the movable pulley 147 is moved downward, the basket 60 coupled by the coupling plate 148 with the movable pulley 147 is moved downward as well.

The fixed pulley 146 is rotationally fixed to the housing 170 and coupled to a plurality of pulleys 150 by the belt 143.

The fixed pulley 146 includes a rotation shaft **146*a* rotationally fixed to the housing 170 and an anti-deviation member 146*b* to prevent deviation of the rotation shaft 146*a***.

Although not shown, the driving shaft 120 and the fixed rod 149 may have the same structure as the fixed pulley 146 to be rotationally fixed to the housing 170.

The movable pulley 147 is provided to be vertically movable inside the housing 70, and coupled to the fixed pulley 146 by the belt 143.

As described above, with the rotation of the driving shaft 120, the movable pulley 147 is moved upward or downward.

Since the lifting apparatus 100 has a double pulley structure including the fixed pulley 146 and the movable pulley 147, the driving motor 110 to rotate the driving shaft 120 may move the basket 60 up or down even with a little driving force.

The driving motor 110 may be miniaturized because it may be able to move the basket 60 vertically with a little force.

With the miniaturized driving motor 110, the space for the driving motor 110 may be reduced, leading to an increase in storage space of the basket 60.

The coupling plate 148 is coupled on one side to the movable pulley 147 and on the other side to a side wall of the basket 60 to be moved vertically along with the movable pulley 147, thereby moving the basket 60 vertically.

There are coupling plate couplers 61 to be coupled with the coupling plates 148 provided on either side wall of the basket 60.

The plurality of pulleys 150 may include the first pulley 151 coupled with the driving shaft 120 and coupled by the first belt 144 to the fixed pulley 146 of the first double pulley 141, the second pulley 153 coupled by the second belt 145 to the fixed pulley 146 of the second double pulley 142, the third pulley 155 coupled with the driving shaft 120 and coupled by the second belt 145 to the second pulley 153, and a fourth pulley 157 provided between the second pulley 153 and the third pulley 155.

The first pulley 151 and the third pulley 155 are coupled with the driving shaft 120 and rotated along with the driving shaft 120.

With the rotation of the driving shaft 120, the belt 143 is wound on or unwound from the first and third pulleys 151 and 155.

The second pulley 153 is coupled by the second belt 145 to the third pulley 155 coupled with the driving shaft 120, so that the rotational force of the driving shaft 120 is transferred to the second double pulley 152.

The fourth pulley 157 is arranged to be adjacent to the third pulley 155 between the second and third pulleys 153 and 155, and is placed lower than the third pulley 155.

The fourth pulley 157 is placed lower than the third pulley 155 to prevent the second belt 145 connecting the third pulley 155 and the second pulley 153 from contacting the basket 60.

The vertical guide rail 160 guides vertical movement of the basket 60 and prevents swaying of the basket 60 while the basket 60 is moving vertically.

The vertical guide rail 160 includes a first vertical guide rail 161 coupled to a side wall of the basket 60, a second vertical guide rail 163 slidingly coupled to the first vertical guide rail 161, and a third guide rail 165 coupled with the housing 170 and slidingly coupled to the second vertical guide rail 163.

There may be bearings provided between the first vertical guide rail 161 and the second vertical guide rail 163 and between the second vertical guide rail 163 and the third vertical guide rail 165 to facilitate smooth sliding motion.

Guide rail coupling holes 63 may be provided on both side walls of the basket 60 to be coupled with the first vertical guide rail 161.

The housing 170 is arranged on either side of the basket 60 by being coupled with the horizontal guide rail 70.

The housing 170 contains the driving motor 110, the driving shaft 120, the double pulley 140, the plurality of pulleys 150, and the vertical guide rail 160.

The housing 170 includes a first housing 171 to contain the first double pulley 141 and a second housing 172 to contain the second double pulley 142, each of which has a side open to the basket 60.

The coupling plate 148 is coupled with the basket 60 through the open side of the first housing 171 or the second housing 172, and the open side provides the space for the coupling plate 148 to be moved vertically.

The first housing 171 and the second housing 172 each equally include a first rotation hole 173 rotationally coupled with the fixed pulley 146, a fixed hole 174 to which the fixed rod 149 is rotationally fixed, a guide rail coupler 175 to which the vertical guide rail 160 is coupled, and an auxiliary plate coupler 176 to which the auxiliary plate 180 is coupled.

Unlike the second housing 172, the first housing 171 may further include a driving motor container 171*a* to contain the driving motor 110, a second rotation hole to which the driving shaft 120 is rotationally coupled, and an anti-exposer 171*c* to prevent the driving shaft 120 from being exposed to the outside.

The second housing 172, unlike the first housing 171, may further include a third rotation hole 172*a* to which the third pulley 155 is rotationally coupled.

The auxiliary plate 180 is coupled at both ends to the auxiliary plate couplers 176 of the housing 170 to connect the first housing 171 and the second housing 172.

The auxiliary plate 180 includes housing couplers 181 to be coupled with the first and second housings 171 and 172 and a fixer 183 to which the other end of the coil spring 190 is fixed.

The auxiliary plate 180 prevents twist when the drawer 60 is pulled into or pulled out of the bottom chamber 25 along with the basket 60.

The coil spring 190 is coupled at one end to the driving shaft 120 by a coupling member 191 and fixed at the other end to the fixer 183 of the auxiliary plate 180.

The coupling member 191 is formed of a flexible material and is wound on the driving shaft 120 or unwound from the driving shaft 120 depending on the rotational direction of the driving shaft 120.

The coupling member 191 is wound on the driving shaft 120 and the coil spring 190 is extended before the basket 60 is moved upward.

While the coil spring 190 is extended, it stores elastic energy, and when the driving shaft 120 is rotated by the driving motor 110 and the coupling member 191 is released from the driving shaft 120, the elastic energy of the coil spring 190 works in a direction in which the driving shaft 120 is rotated.

Since the elastic energy of the coil spring 190 works in the direction in which the driving shaft 120 is rotated, the driving motor 110 to rotate the driving shaft 120 may move the basket 60 upward even with a little driving force.

The driving motor 110 may be miniaturized because it may be able to move the basket 60 upward with a little force.

With the miniaturized driving motor 110, the space for the driving motor 110 may be reduced, leading to an increase in storage space of the basket 60.

Furthermore, initial driving force of the driving motor 110 may be reduced, and thus, a load generated on the driving motor 110 may be reduced as well.

Although it is shown that the coil spring 190 transfers energy to the driving shaft 120 to reduce the initial driving force of the driving motor 110, it is not limited thereto.

The coil spring 190 may be replaced by a gas spring or a constant force spring that may transfer energy to the driving shaft 120.

Figure 10:
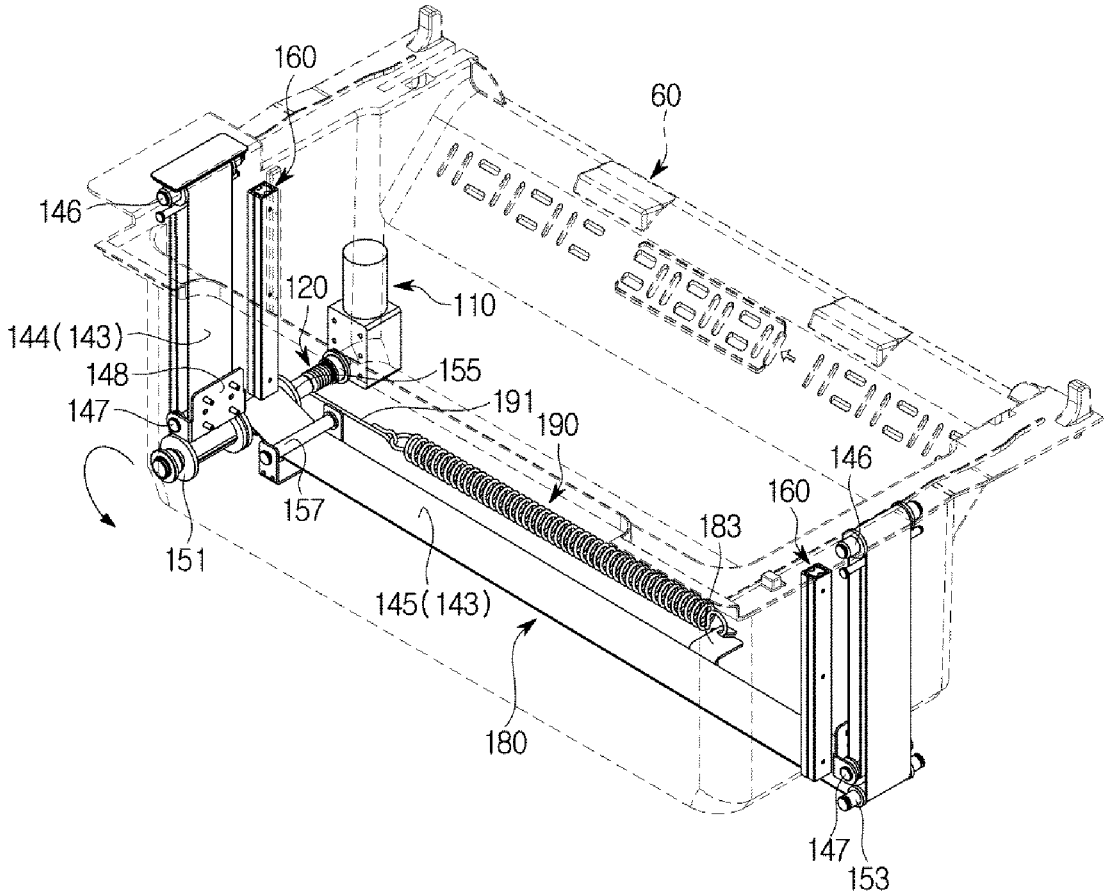
FIG. 10 shows a state in which a drawer is pulled out of a bottom chamber, according to an embodiment of the present disclosure.
Figure 11:
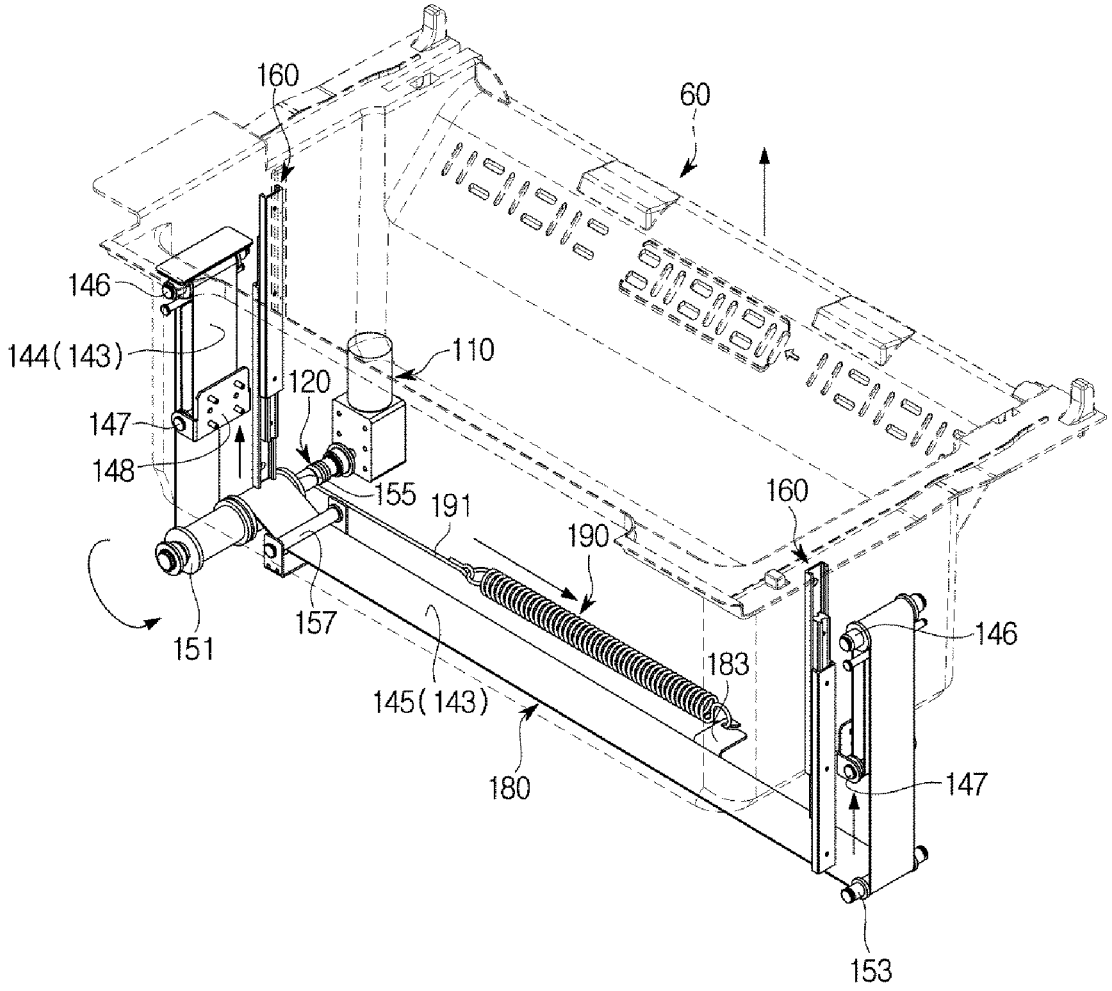
FIG. 11 shows a basket being moved up by a lifting apparatus, according to an embodiment of the present disclosure.
Figure 12:
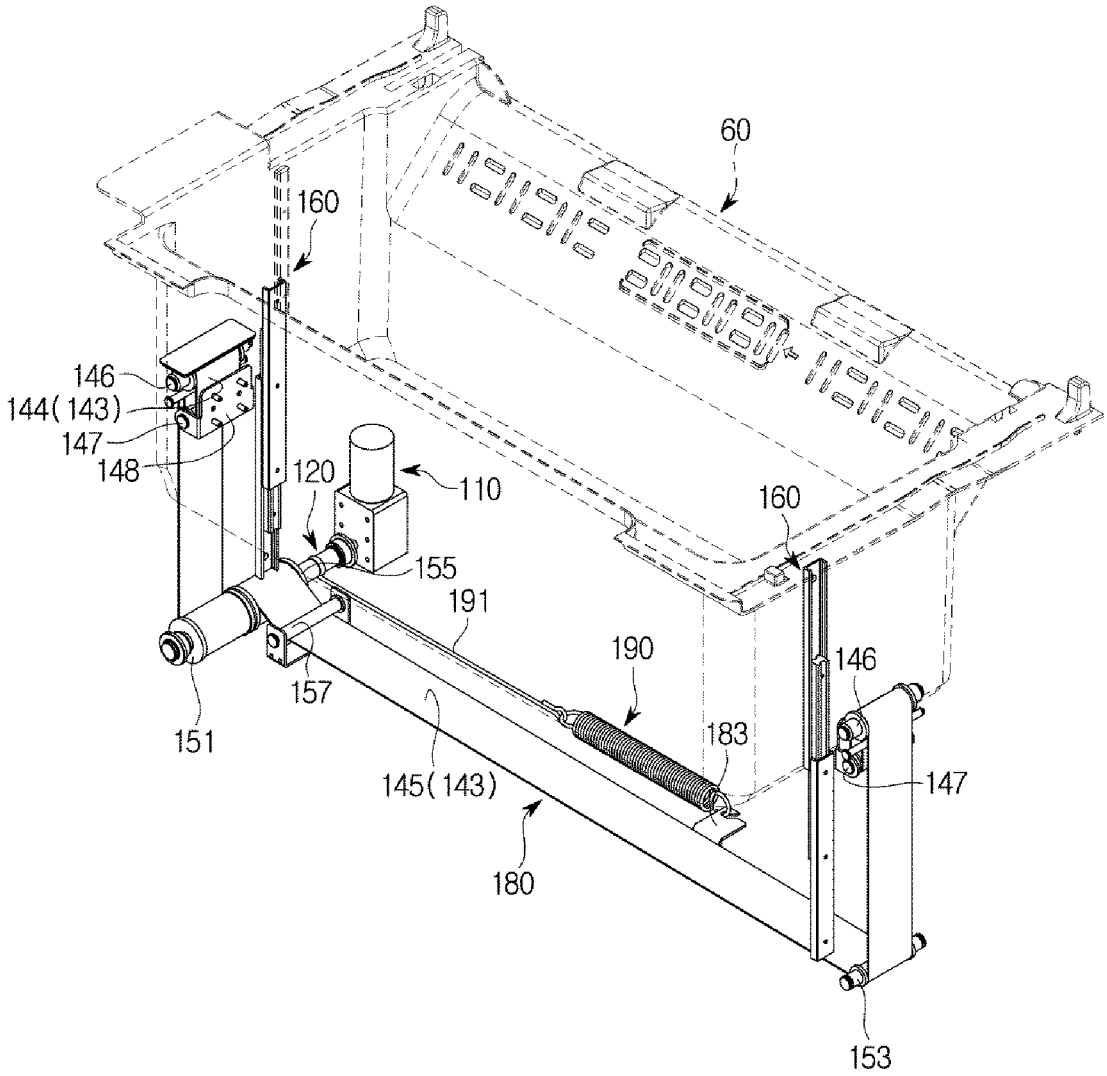
FIG. 12 shows a basket that has been moved up by a lifting apparatus, according to an embodiment of the present disclosure.

Next, referring to FIGS. 10 to 12, operation of the basket 60 being vertically moved by the lifting apparatus 100 will not be described in detail.

FIG. 10 shows a state in which a drawer is pulled out of a bottom chamber, according to an embodiment of the present disclosure, FIG. 11 shows a basket being moved up by a lifting apparatus, according to an embodiment of the present disclosure, and FIG. 12 shows a basket that has been moved up by a lifting apparatus, according to an embodiment of the present disclosure.

Referring to FIG. 10, while the drawer 60 is pulled out of the bottom chamber 25, the coupling member 191 is wound on the driving shaft 120 and the coil spring 190 is extended.

The extended coil spring 190 stores elastic energy.

Referring to FIG. 11, when the driving motor 110 is driven, the driving shaft 120 is rotated in the direction of the arrow shown in FIG. 11, and the first belt 144 and the second belt 145 are wound on the first pulley 151 and the third pulley 155, respectively.

When the driving shaft is rotated, the elastic energy stored in the coil spring 190 is transferred in the direction in which the driving shaft 120 is rotated, and thus the driving force of the driving motor 110 may be reduced by as much as the elastic energy of the coil spring 190, thereby miniaturizing the driving motor 110.

When the first belt 144 and the second belt 145 are wound on the first pulley 151 and the third pulley 155, respectively, the movable pulleys 147 of the first and second double pulleys 141 and 142 are moved upward.

When the movable pulleys 147 are moved upward, the coupling plates 148 coupled with the movable pulleys 147 are moved upward as well.

Since the coupling plates 148 are coupled to both side walls of the basket 60, the basket 60 is moved upward when the coupling plates 148 are moved upward.

Referring to FIG. 12, when the basket 60 is moved up to the maximum height, the driving motor 110 is stopped.

When the driving motor 110 is driven to move the basket 60 down from the maximum height, the driving shaft 120 is rotated in the opposite direction to the direction of the arrow of FIGS. 10 and 11.

When the driving shaft 120 is rotated, the first belt 144 and the second belt 145 wound on the first pulley 151 and the third pulley 155, respectively, are unwound and the movable pulleys 147 are moved downward.

When the movable pulleys 147 are moved downward, the coupling plates 148 coupled with the movable pulleys 147 are moved downward as well.

Since the coupling plates 148 are coupled to both side walls of the basket 60, the basket 60 is moved downward when the coupling plates 148 are moved downward.

When driving shaft 120 is rotated to move the basket 60 downward, the coupling member 191 is wound on the driving shaft 120 and the coil spring 190 is extended while storing the elastic energy.

According to embodiments of the present disclosure, a driving motor may be miniaturized and the load of the driving motor may be reduced.

Several embodiments have been described above, but a person of ordinary skill in the art will understand and appreciate that various modifications can be made without departing the scope of the present disclosure. Thus, it will be apparent to those ordinary skilled in the art that the true scope of technical protection is only defined by the following claims.

What is claimed is:

1. A refrigerator comprising:

a main body;

a storeroom formed inside the main body with an open front;

a drawer slidingly coupled with the main body to open or close the storeroom and provided at a lower side thereof with a basket having storage space; and a lifting apparatus configured to move the basket vertically, wherein the lifting apparatus comprises:

a driving motor;

a driving shaft rotated by the driving motor;

a lifting unit configured to move the basket vertically by using rotational force of the driving shaft; and a coil spring coupled to the driving shaft and transferring energy in a direction in which the driving shaft is rotated to reduce a load of the driving motor, when the driving shaft is rotated to move the basket upward.

2. The refrigerator of claim 1, wherein the lifting unit comprises a double pulley moving the basket vertically, a plurality of pulleys transferring rotational force of the driving shaft to the double pulley, a vertical guide rail guiding vertical movement of the basket, and a housing in which the double pulley is installed.

3. The refrigerator of claim 2, wherein the double pulley comprises a first double pulley and a second double pulley arranged on either side of the basket.

4. The refrigerator of claim 3, wherein the first double pulley and the second double pulley comprise a belt coupled at one end to at least one of the plurality of pulleys, a fixed pulley fixed to the housing and coupled by the belt to at least one of the plurality of pulleys, a movable pulley coupled by the belt to the fixed pulley to be vertically moved inside the housing, a coupling plate coupled to a side wall of the basket to be vertically moved along with the movable pulley, and a fixed rod to which the other end of the belt is fixed.

5. The refrigerator of claim 4, wherein the plurality of pulleys comprises a first pulley coupled with the driving shaft and coupled by the belt to the fixed pulley of the first double pulley, a second pulley coupled by the belt to the fixed pulley of the second double pulley, and a third pulley coupled by the belt to the second pulley.

6. The refrigerator of claim 5, wherein the belt has a width three times larger than its thickness to keep the basket horizontally balanced while the basket is vertically moving.

7. The refrigerator of claim 6, wherein the belt comprises a first belt coupling the fixed pulley and the movable pulley of the first double pulley and the first pulley, and a second belt coupling the fixed pulley and the movable pulley of the second double pulley and the second pulley.

8. The refrigerator of claim 7, wherein the plurality of pulleys further comprise a fourth pulley arranged to be adjacent to the third pulley between the second pulley and the third pulley, and placed lower than the third pulley to prevent contact between the second belt and the basket.

9. The refrigerator of claim 4, wherein the housing comprises a first housing containing the first double pulley and a second housing containing the second double pulley, and the first and second housings each have one open side for the coupling plate to be coupled with the basket to be vertically moved.

10. The refrigerator of claim 9, wherein the first housing and the second housing comprise a first rotation hole to which the fixed pulley is rotationally coupled, a fixed hole to which the fixed rod is fixed, and a guide rail coupler to which the vertical guide rail is coupled.

11. The refrigerator of claim 10, wherein the first housing further comprises a driving motor container in which the driving motor is contained, a second rotation hole to which the driving shaft is rotationally coupled, and an anti-exposer preventing the driving shaft from being exposed to outside.

12. The refrigerator of claim 10, wherein the second housing further comprises a third rotation hole to which a third pulley is rotationally coupled.

13. The refrigerator of claim 10, wherein the first housing and the second housing are coupled at bottom ends thereof with an auxiliary plate to connect the first housing and the second housing, the auxiliary plate comprising a fixer to which the other end of the coil spring is fixed.

14. The refrigerator of claim 13, wherein the coil spring is coupled at one end to the driving shaft by a coupling member, the coupling member being formed of a flexible material and wound on the driving shaft or unwound from the driving shaft depending on the direction of rotation of the driving shaft.

15. The refrigerator of claim 14, wherein when the driving shaft is rotated to move the basket upward, the coupling member wound on the driving shaft is unwound and elastic energy of the coil spring is transferred to the driving shaft, and when the driving shaft is rotated to move the basket downward, the coupling member is wound on the driving shaft and the coil spring stores elastic energy.

16. A refrigerator comprising:

a main body;

a storeroom formed inside the main body with an open front;

a drawer slidingly coupled with the main body to open or close the storeroom and provided at a lower side thereof with a basket having store space; and a lifting apparatus configured to move the basket vertically, wherein the lifting apparatus comprises:

a driving motor;

a driving shaft rotated by the driving motor;

a lifting unit comprising a belt coupled to the driving shaft, a fixed pulley fixed not to be moved and coupled to the driving shaft by the belt, and a movable pulley coupled to the fixed pulley by the belt to be vertically moved to move the basket vertically; and a coil spring coupled to the driving shaft and transferring energy in a direction in which the driving shaft is rotated to reduce a load of the driving motor, when the driving shaft is rotated to move the basket upward.

17. The refrigerator of claim 16, wherein the lifting unit further comprises a plurality of pulleys coupled to one end of the belt, a fixed rod to which the other end of the belt is fixed, a vertical guide rail guiding vertical movement of the basket to prevent swaying of the basket.

18. A lifting apparatus for moving a basket vertically, the lifting apparatus comprising:

a driving motor generating driving force;

a driving shaft rotated by the driving motor;

a belt coupled to the driving shaft;

a fixed pulley coupled by the belt to the driving shaft and fixed not to be moved;

a movable pulley coupled to the fixed pulley by the belt to be vertically moved;

a coupling plate coupled with a side wall of the basket and vertically moved along with the movable pulley; and a coil spring coupled to the driving shaft and transferring energy in a direction in which the driving shaft is rotated to reduce a load of the driving motor, when the driving shaft is rotated to move the basket upward.

19. The lifting apparatus of claim 18, wherein the fixed pulley, the movable pulley, and the coupling plate are each provided in pair and arranged on both side walls of the basket, and the fixed pulleys are fixed to a pair of housings arranged on both side walls of the basket.

20. The lifting apparatus of claim 19, wherein the pair of housings are coupled at bottom ends thereof with an auxiliary plate to connect the pair of housings, and the coil spring is coupled at one end to the driving shaft by a coupling member and fixed at the other end to a fixer arranged on the auxiliary plate.

* * * * *